US010190798B2

(12) United States Patent
Zheng et al.

(10) Patent No.: US 10,190,798 B2
(45) Date of Patent: Jan. 29, 2019

(54) AIR DEFLECTOR DEVICE AND AIR CONDITIONER

(71) Applicant: GREE ELECTRIC APPLIANCES, INC. OF ZHUHAI, Zhuhai (CN)

(72) Inventors: Heqing Zheng, Zhuhai (CN); Wuzhan Ye, Zhuhai (CN); Tangtang Gu, Zhuhai (CN); Wenwei Ji, Zhuhai (CN); Zhihui Liang, Zhuhai (CN); Mang Chi, Zhuhai (CN); Chao Li, Zhuhai (CN); Xiong Gao, Zhuhai (CN)

(73) Assignee: GREE ELECTRIC APPLIANCES, INC. OF ZHUHAI, Zhuhai, Guangdong (CN)

( * ) Notice: Subject to any disclaimer, the term of this patent is extended or adjusted under 35 U.S.C. 154(b) by 177 days.

(21) Appl. No.: 14/997,024

(22) Filed: Jan. 15, 2016

(65) Prior Publication Data

US 2016/0131393 A1 May 12, 2016

Related U.S. Application Data

(63) Continuation of application No. PCT/CN2014/082211, filed on Jul. 15, 2014.

(30) Foreign Application Priority Data

Jul. 19, 2013 (CN) ..... 2013 1 0307238

(51) Int. Cl.
*F24F 13/10* (2006.01)
*F24F 13/14* (2006.01)

(52) U.S. Cl.
CPC ..... *F24F 13/10* (2013.01); *F24F 1/0011* (2013.01); *F24F 1/022* (2013.01); *F24F 13/1486* (2013.01)

(58) Field of Classification Search
CPC ..... F24F 13/10; F24F 1/022
(Continued)

(56) References Cited

U.S. PATENT DOCUMENTS 3,294,008 A * 12/1966 Cotts ..... F24D 19/04 454/288
2008/0254733 A1* 10/2008 Mutton ..... E21F 1/08 454/169
2013/0109289 A1* 5/2013 Cheng ..... G06F 1/206 454/184

FOREIGN PATENT DOCUMENTS

CN 2816662 Y 9/2006
CN 101625142 * 1/2010
(Continued)

OTHER PUBLICATIONS

International Search Report in Application No. PCT/CN2014/082211 dated Sep. 30, 2014.

*Primary Examiner* — Steven B McAllister
*Assistant Examiner* — Ko-Wei Lin
(74) *Attorney, Agent, or Firm* — Hauptman Ham, LLP

(57) ABSTRACT

An air deflector device includes an air deflector provided with rotating shaft inserting channels, and a rotating shaft system. One end of the rotating shaft system is provided with a first connecting part configured to connect with a driving device, and the other end of the rotating shaft system is provided with a second connecting part configured to connect with a case of an air conditioner. The rotating shaft system includes air deflector rotating shafts, and each air deflector rotating shaft includes an inserting plate engageable with the rotating shaft inserting channel. An air conditioner having the air deflector device is also disclosed.

15 Claims, 5 Drawing Sheets

(58) Field of Classification Search
USPC ..... 454/155, 333, 284, 322
See application file for complete search history.

(56) References Cited

FOREIGN PATENT DOCUMENTS

| | | | | |
|---|---|---|---|---|
| CN | 101625142 | A | | 1/2010 |
| CN | 201439982 | U | | 4/2010 |
| CN | 202885198 | U | | 4/2013 |
| CN | 203068755 | U | | 7/2013 |
| CN | 203385169 | U | | 1/2014 |
| JP | 3608488 | B2 | | 1/2005 |
| JP | 2008111600 | A | | 5/2008 |
| JP | 2009052834 | A | * | 3/2009 |
| JP | 2012102949 | A | | 5/2012 |

* cited by examiner

AIR DEFLECTOR DEVICE AND AIR CONDITIONER

CROSS REFERENCE TO RELATED APPLICATIONS

This application is a continuation application of PCT Patent Application No. PCT/CN2014/082211, entitled "Air Deflector Device and Air Conditioner", filed on Jul. 15, 2014, which claims priority to Chinese Patent Application No. 201310307238.4, entitled "Air Deflector Device and Air Conditioner", filed on Jul. 19, 2013, the entire contents of which are incorporated herein by reference.

TECHNICAL FIELD

The present disclosure relates to the technical field of air conditioners, more particularly, to an air deflector device and an air conditioner.

BACKGROUND

In order to control directions of discharged air from the air conditioner, an air deflector device is commonly provided at the air outlet. Currently, the air deflector and the air deflector rotating shaft of the air deflector device are integral, namely, the air deflector and air deflector rotating shaft is an integrated structure. In order to ensure that the air deflector can swing around the shaft to regulate the angle of the discharged air, the first rotating shaft at one end of the air deflector should be mounted on the case of the air conditioner, and the second rotating shaft at the other end of the air deflector is connected with a driving device. The air deflector is driven to swing by the driving device.

In order to ensure that the air deflector device assembled is not easily released, the distance between the two rotating shafts, which are respectively provided at two ends of the air deflector, is designed to be greater than the distance between the first connection location on the case of the air conditioner and the second connection location on the driving device, namely, greater than the distance between the first location where the case of the air conditioner and the first rotating shaft are connected together, and the second location where the driving device and the second rotating shaft are connected together.

As the air deflector and the air deflector rotating shaft in the prior art are an integrated structure, the air deflector must be deformed and bent in order to assemble the integrated structure. However, as the air deflector is not easily deformed, a groove needs to be provided in the air deflector rotating shaft, by means of the groove, the air deflector is clamped with the case of the air conditioner and clamped with the rotating shaft of the driving device, thereby realizing the assembling of the air deflector. This manner of assembling requires a high precision air deflector rotating shaft. Namely, a high precision is required for the width of the groove provided in the air deflector rotating shaft. If the width is too small, the clamping cannot be done; if the width is too large, the air deflector is easily released.

Therefore, it becomes a problem to be solved urgently by those skilled in this technical field how to assemble the air deflector, which is not easily deformed, with a reduced precision required for the air deflector rotating shaft.

SUMMARY OF THE INVENTION

In view of the situations in the prior art, the objective of the present disclosure is to provide an air deflector device capable of solving the problems in assembling the air deflector which is not easily deformed, with a reduced precision required for the rotating shaft for the air deflector.

Another objective of the present disclosure is to provide an air conditioner having the air deflector device above.

In order to realize the objectives above, the present disclosure provides technical schemes as follows:

An air deflector device comprises an air deflector provided with rotating shaft inserting channels, and a rotating shaft system; wherein one end of the rotating shaft system is provided with a first connecting part configured to connect with a driving device; the other end of the rotating shaft system is provided with a second connecting part configured to connect with a case of an air conditioner; the rotating shaft system comprises air deflector rotating shafts; each air deflector rotating shaft comprises an inserting plate engageable with corresponding rotating shaft inserting channel.

In one of the embodiments of the air deflector device, a locking post is provided in each rotating shaft inserting channel, and an end of the inserting plate is provided with a locking groove for clamping the locking post.

In one of the embodiments of the air deflector device, the rotating shaft system comprises at least two air deflector rotating shafts; every adjacent two rotating shafts are connected through a connecting rod.

In one of the embodiments of the air deflector device, the connecting rod and the air deflector rotating shafts are injection molded into an integral piece.

In one of the embodiments of the air deflector device, the air deflector rotating shaft further comprises a bent part; one end of the bent part is provided with a fitting portion matching with the connecting rod; the other end of the bent part is connected with the inserting plate.

In one of the embodiments of the air deflector device, the inserting plate is connected with the bent part through a connecting plate; each rotating shaft inserting channel includes an anti-collision groove matching with the connecting plate.

In one of the embodiments of the air deflector device, a thickness of the bent part at a junction between the bent part and the connecting plate, is greater than thickness of the connecting plate.

In one of the embodiments of the air deflector device, the air deflector comprises an inner part and an outer part, which are assembled together; the rotating shaft inserting channels are disposed in the inner part of the air deflector; a stop edge is disposed in the outer part of the air deflector for each corresponding rotating shaft inserting channel, and extends to a socket of the rotating shaft inserting channel.

In one of the embodiments of the air deflector device, quantity of the air deflector rotating shafts for deflector is from 2 to 4.

The present invention further discloses an air conditioner, which comprises a case, a driving device and an air deflector device, wherein, the driving device is any one as described above; a first connecting part of the rotating shaft system of the air deflector device is connected with the driving device; a second connecting part of the rotating shaft system is connected with the case of the air conditioner.

As can seen from the technical schemes above, compared with the traditional air conditioners, the air deflector device of the present disclosure is divided into two parts, i.e., the air deflector and the rotating shaft system. Several rotating shafts are connected into an integral piece, enabling the rotating shafts to rotate in the same direction and at the same speed. The first connecting part of the rotating shaft system is connected with the driving device, and the second connecting part is connected with the case of the air conditioner, thereby realizing the assembling of the rotating shaft system. What's more, the rotating shaft system is driven to rotate by the rotating driving device. The air deflector and the rotating shaft system are assembled by fitting and clamping the inserting plates in the rotating shaft inserting channels provided in the air deflector, and the air deflector is driven to rotate by the rotating shaft system.

In the present disclosure, firstly, the rotating shaft system is connected with the case of the air conditioner and connected with the driving device. As the air deflector has not been installed yet, the assembling of the rotating shaft system will not be influenced by the air deflector which is not easily deformed. As the air deflector device of the present disclosure is divided into two detachable parts, the rotating shaft system can be assembled with the case of the air conditioner and with the driving device without the need of disposing a groove in the air deflector rotating shaft, thereby the precision required for the rotating shaft is reduced.

Since the air deflector device of the present disclosure has technical effects above, the air conditioner having the air deflector device have the same technical effects, which will not be described repeatedly in this disclosure.

BRIEF DESCRIPTION OF THE DRAWINGS

In order to describe the technical schemes in the embodiments of the present invention or the technical schemes of the prior art more clearly, the figures, which are necessary for the description of the embodiments and the prior art, will be described briefly below. It is apparent that the figures described below are merely embodiments of the present invention, and other figures could be obtained on the basis of these figures without paying creative work by those skilled in the art.

DETAILED DESCRIPTION OF THE PREFERRED EMBODIMENTS

One main objective of the present disclosure is to provide an air deflector device capable of solving the problems in assembling the air deflector which is not easily deformed, with a reduced precision required for the air deflector rotating shaft.

Another main objective of the present disclosure is to provide an air conditioner having the air deflector device above.

The embodiments of the present disclosure will be described more clearly and in more details with reference to the accompanying figures. It is apparent that the embodiments described below are merely a part of embodiments of the present invention, but not all of the embodiments. It should be noted that other embodiments, which are obtained based on the embodiments in the present disclosure without paying creative work by those skilled in the art, shall fall within the scope of the present invention.

Figure 1:
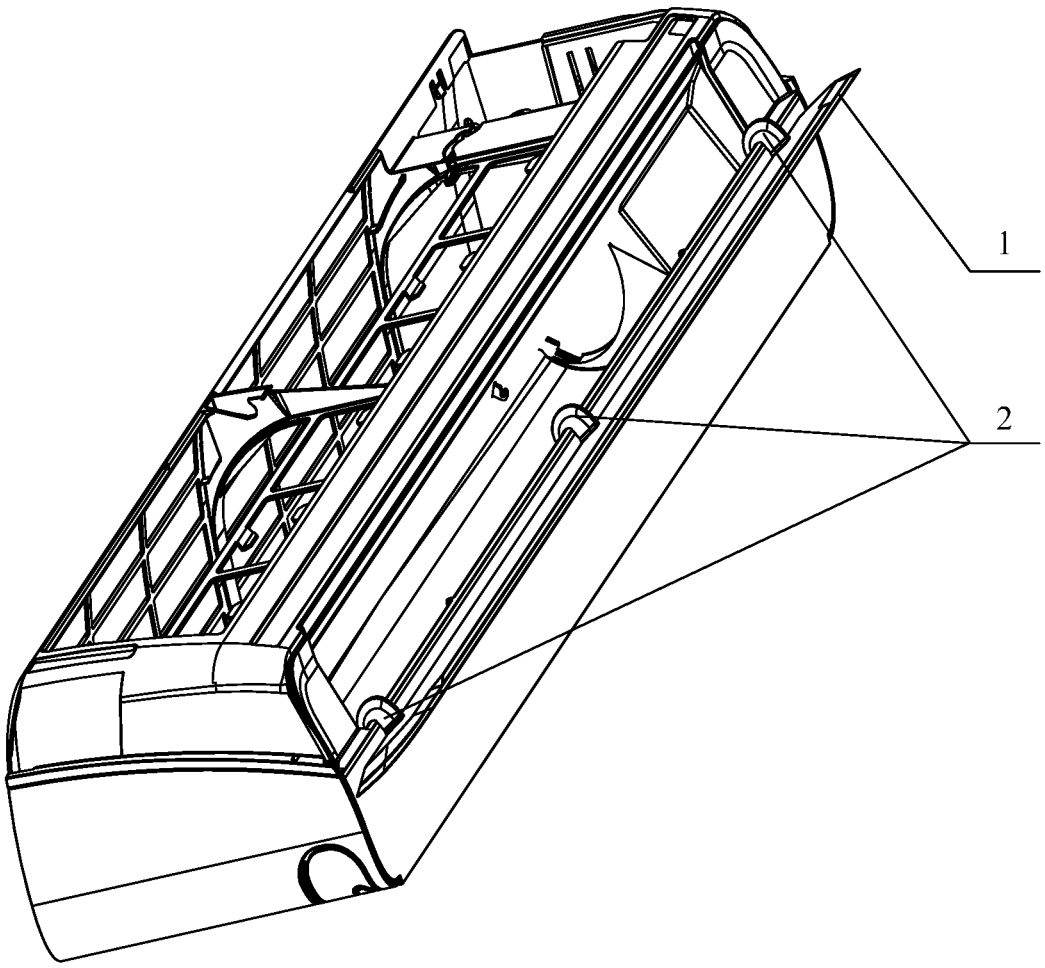
FIG. 1 is a schematic structural diagram of the air conditioner according to one embodiment of the present invention.
Figure 2:
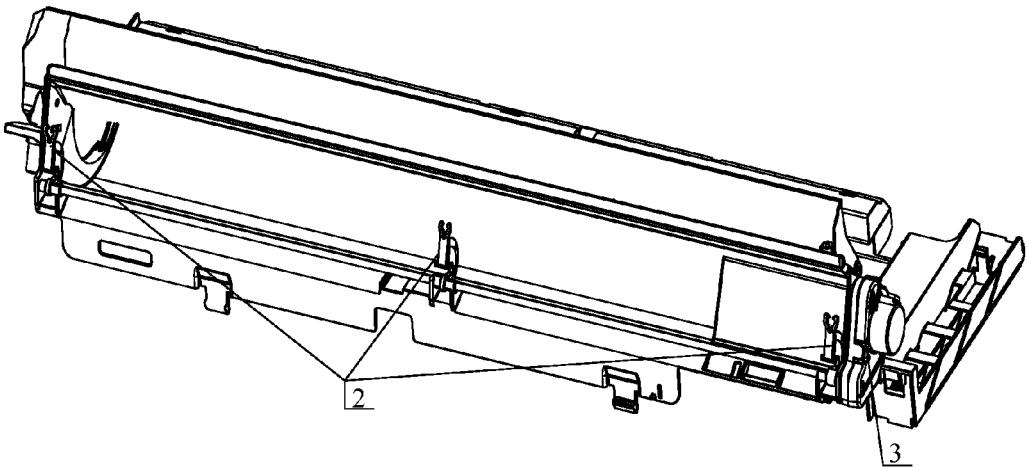
FIG. 2 is a schematic structural diagram illustrating the assembled rotating shaft system of the air deflector device according to one embodiment of the present invention.
Figure 3:
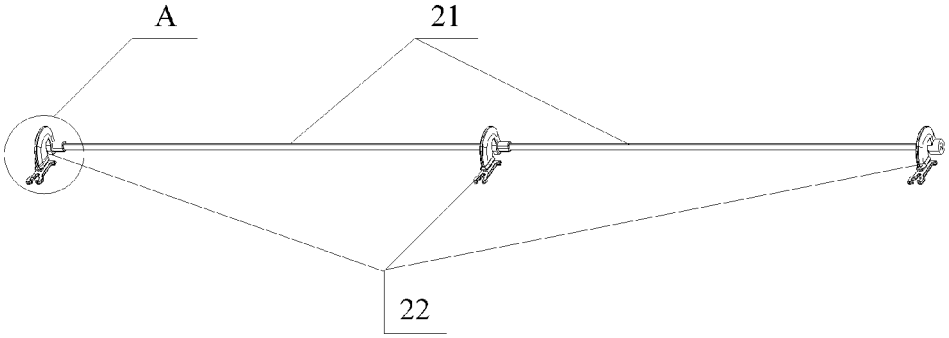
FIG. 3 is a schematic structural diagram illustrating the rotating shaft system of the air deflector device according to one embodiment of the present invention.
Figure 4:
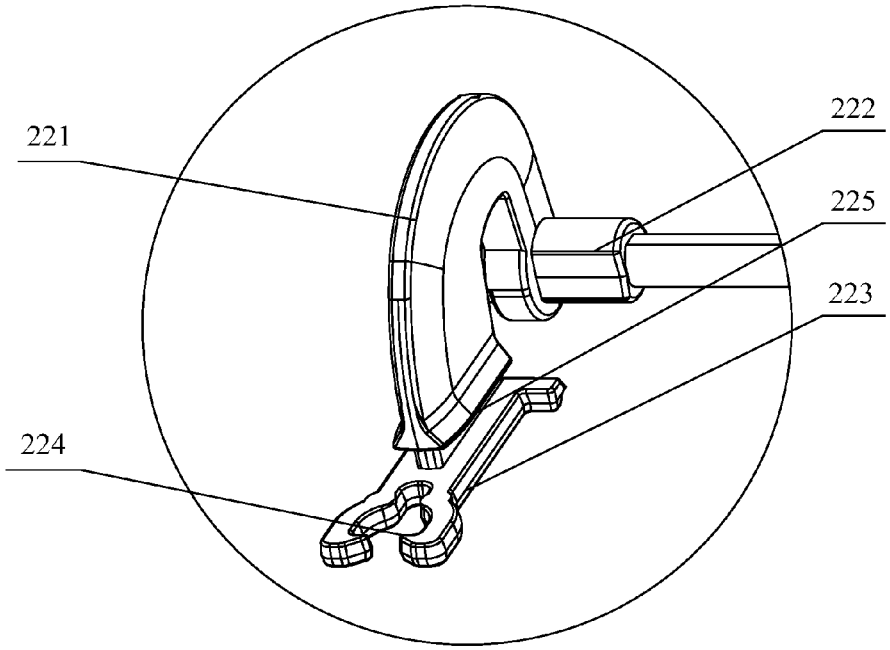
FIG. 4 is an enlarged partial diagram illustrating the part A in FIG. 3.
Figure 5:
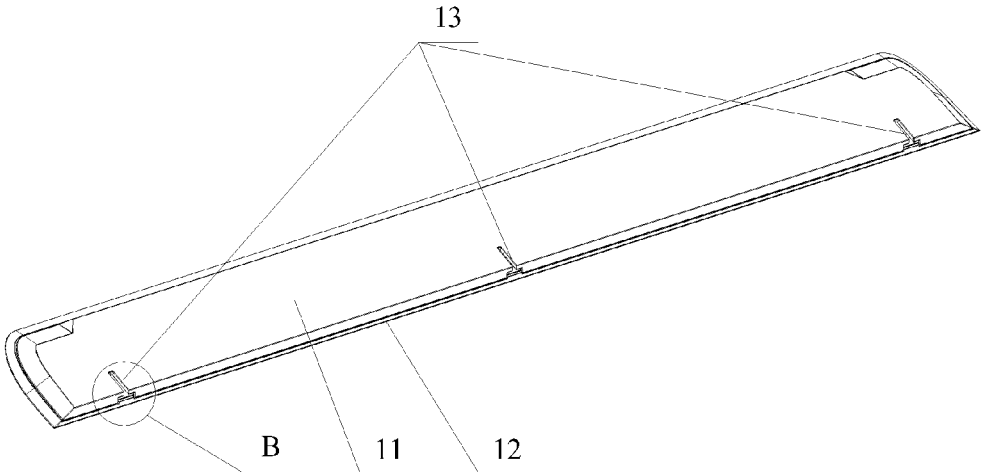
FIG. 5 is a schematic structural diagram illustrating the air deflector of the air deflector device according to one embodiment of the present invention.

As shown in FIGS. 1-5, FIG. 1 is a schematic structural diagram of the air conditioner according to one embodiment of the present invention; FIG. 2 is a schematic structural diagram illustrating the assembled rotating shaft system according to one embodiment of the present invention; FIG. 3 is a schematic structural diagram illustrating the rotating shaft system according to one embodiment of the present invention; FIG. 4 is an enlarged partial diagram illustrating the part A in FIG. 3; FIG. 5 is a schematic structural diagram illustrating the air deflector according to one embodiment of the present invention.

According to one embodiment of the present invention, the air deflector device includes an air deflector 1 and a rotating shaft system 2.

The rotating shaft inserting channels 13 are disposed in the air deflector 1 and are configured to fit with the rotating shaft system 2. It should be noted that, each of the rotating shaft inserting channels 13 should be provided with a socket 130, so that the air deflector rotating shaft 22 can be inserted into the rotating shaft inserting channel 13 through the socket 130.

One end of the rotating shaft system 2 is provided with a first connecting part configured to connect with a driving device, and the other end of the rotating shaft system 2 is provided with a second connecting part configured to connect with the case of the air conditioner. The structure of the first connecting part and the structure of the second connecting part may be just the same as those known in the prior art, as long as the connecting parts can connect the rotating shaft with the case of the air conditioner and with the driving device, the structure of the connecting part is not the emphasis of the innovation of the present disclosure and will not be described specifically.

The rotating shaft system 2 includes air deflector rotating shafts 22, the quantity of which depends on practical requirements. In order to increase the stability of the connection, generally, two or more rotating shafts 22 are provided. In this embodiment, the quantity of the rotating shafts 22 for deflector is from 2 to 4, preferably, the quantity is 3. It should be noted that when only one rotating shaft 22 is provided, the connection between the rotating shaft and the air deflector 1 can be realized as well.

The rotating shaft 22 is configured to connect with the air deflector 1. The rotating shaft 22 includes an inserting plate 223 engageable with the rotating shaft inserting channel 13. The air deflector 1 and the rotating shaft system 2 are assembled together by fitting and clamping the inserting plate 223 in the rotating shaft inserting channels 13.

In this embodiment, the air deflector device is divided into two parts, namely, the air deflector 1 and the air deflector rotating shaft 22. Several rotating shafts 22 are connected into an integral piece, which can rotate in the same direction and at the same speed. The first connecting part of the rotating shaft system 2 is connected with the driving device 3, and the second connecting part is connected with the case of the air conditioner, thereby realizing the assembling of the rotating shaft system 2. What's more, the rotating shaft system 2 is driven to rotate by the rotating driving device. The air deflector 1 and the rotating shaft system 2 are assembled together by fitting and clamping the inserting plates 223 in the rotating shaft inserting channels 13 provided in the air deflector, and the air deflector 1 is driven to rotate by the rotating shaft system 2.

In the present invention, firstly, the rotating shaft system 2 is connected with the case of the air conditioner and with the driving device 3. As the air deflector 1 has not been installed yet, the assembling of the rotating shaft system 2 will not be influenced by the air deflector which is not deformed easily. As the air deflector device of the present disclosure is divided into two parts, the rotating shaft system 2 can be assembled with the case of the air conditioner and with the driving device 3 without the need of disposing a groove in the air deflector rotating shaft, thereby the precision required for the air deflector rotating shaft is reduced.

In this embodiment, the air deflector 1 and the rotating shaft system 2 are detachably connected by means of fitting and clamping. It should be understood by those skilled in the art that the air deflector 1 and the rotating shaft system 2 may be connected with connecting pieces. For example, the air deflector 1 and the rotating shaft system 2 can be assembled together with bolts, rivets or other connecting pieces. As compared with the manner of connecting with connecting pieces, the manner of direct fitting and clamping has advantages of quick assembling and disassembling.

Figure 7:
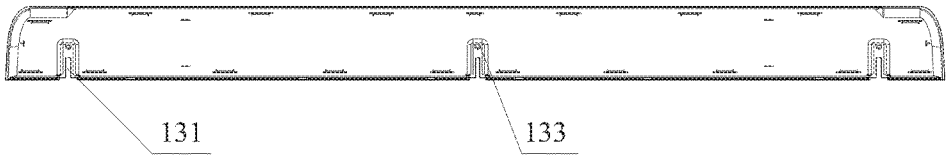
FIG. 7 is a schematic structural diagram illustrating the inner part of the air deflector device according to one embodiment of the present invention.

As shown in FIG. 4 and FIG. 7, a locking post 133 is provided in the rotating shaft inserting channel 13, and an end of the inserting plate 223 is provided with a locking groove 224 for clamping the locking post 133. In order to ensure that the locking groove 224 can lock the locking post 133 and is not easily released, the dimension between the opening ends of the locking groove 224 should be less than the dimension of the locking post 133 (It should be understood that the dimension of the locking post 133 is the dimension of the tail end of the locking post 133, that is, the dimension of the locking post 133 at the position where the opening ends of the locking groove 224 engage with the locking post 133 after they are assembled). The inserting plate 223 is inserted into the rotating shaft inserting channel 13, and the inserting plate 223 is moved towards the locking post 133. When the locking groove 224 touches the locking post 133, along with the inward moving of the inserting plate 223, the opening ends of the locking groove 224 will be opened wider by the locking post 133, and the opening ends of the locking groove 224 will restore to its original shape when the locking post 133 is completely locked into the locking groove 224, thereby locking the locking post 133 and preventing the locking post 133 from releasing out of the locking groove 224.

Generally, the locking groove 224 is provided at an end of the inserting plate 223, and the width of the inserting plate 223 is not too wide, and thus, with the locking groove 224 disposed in the inserting plate 223, side portions of the locking groove 224 at two sides are relatively narrow. Therefore, the side portions have some deformability, enabling the locking post 133 to be locked in.

Figure 8:
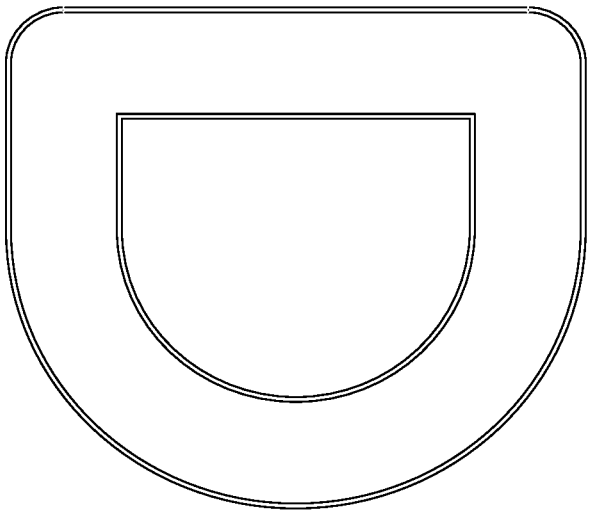
FIG. 8 is a section view of the locking post of the air deflector device according to one embodiment of the present invention.
Figure 9:
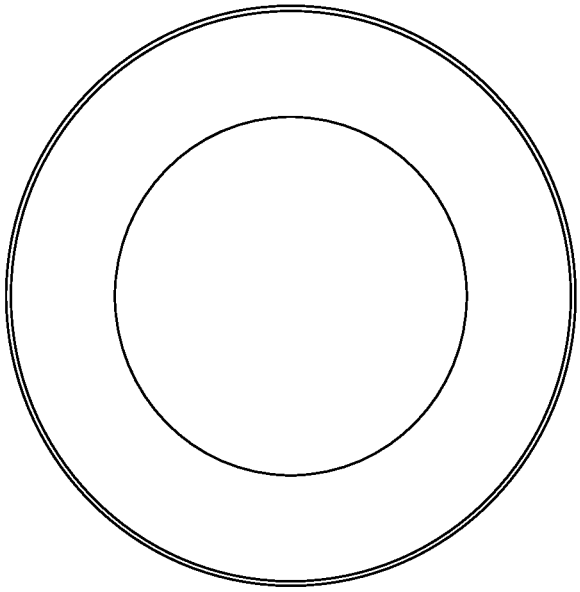
FIG. 9 is a section view of the locking post of the air deflector device according to another embodiment of the present invention.

The locking post 133 may be of any shape, and generally it is designed to have a cylindrical structure shown in FIG. 9, or have the structure constituted by an arc portion and a rectangular portion shown in FIG. 8. What's more, the arc portion is close to the inserting plate 223, ensuring that the locking groove 224 meets the arc portion first. As the width of the arc portion increases gradually, the opening ends of the locking groove are opened wider slowly.

It should be understood by the skilled in this technology field that the locking groove may be designed into different structures, so as to match with locking posts of different shapes. If the locking post 133 has the structure constituted by an arc portion and a rectangular portion shown in FIG. 8, the locking groove 224 may be designed to have the structure shown in FIG. 4, namely, the opening ends of the locking groove 224 extend inwardly, so as to clamp the rectangle-shaped bottom portion of the locking post 133. If the locking post 133 has a cylindrical structure shown in FIG. 9, the locking groove 224 may be designed into an arc-shaped groove, which can fit with the outer surface of the cylinder-shaped locking post 133. In order to prevent the locking post 133 from releasing out of the locking groove 224 easily, it should be ensured that the central angle of the arc-shaped groove is greater than 180 degrees, namely, the width between the opening ends of the locking groove 224 is less than the diameter of the locking post 133.

As shown in FIG. 3, in one of the embodiments of the present invention, the rotating shaft system 2 includes at least two air deflector rotating shafts 22, and every adjacent two rotating shafts 22 are connected through a connecting rod 21. The rotating shaft 22 at one end is connected with the driving device, and the rotating shaft 22 at the other end is rotatablely connected with the case of the air conditioner.

Further, the connecting rod 21 and the air deflector rotating shafts 22 are molded into an integral piece. The connecting rod 21 may be a metal bar. The connecting rod 21 and the rotating shafts 22 are molded through injection, through a process of designing the mould, the parts produced by injection molding come out as an integral piece, which ensures the accurate assembly positioning of the rotating shafts 22 and the reliability of the connection.

As shown in FIG. 4, the air deflector rotating shaft 22 includes a bent part 221 and an inserting plate 223.

Wherein, one end of the bent part 221 is provided with a fitting portion 222 matching with the connecting rod 21. In the present disclosure, the bent part 221 is configured to avoid the interference caused by the case of the air conditioner, with the bent part 221 provided, the rotating shaft 22 is prevented from interfering with certain parts of the case of the air conditioner when the rotating shaft 22 rotates.

The other end of the bent part 221 is connected with the inserting plate 223. The inserting plate 223 is configured to be inserted into the rotating shaft inserting channel 13. As the air deflector 1 is too long, and the tolerance will increase with the length, in consideration of which, in the present disclosure, the fitting arrangements between the rotating shafts 22 located at two sides and the rotating shaft inserting channel 13 is a bit different from the fitting arrangements between the rotating shaft 22 located in the middle and the rotating shaft inserting channel 13, so as to avoid influences caused by the accumulated tolerance.

Further, the inserting plate 223 is connected with the bent part 221 through a connecting plate 225. The rotating shaft inserting channel 13 includes an anti-collision groove 131 matching with the connecting plate 225.

When the inserting plate 223 is inserted into the rotating shaft inserting channel 13, the connecting plate 225 is inserted into the anti-collision groove 131. After the inserting plate 223 is in place, the connecting plate 225 reaches the farmost end of the anti-collision groove 131. In the present disclosure, in addition to the fitting between the inserting plate 223 and the rotating shaft inserting channel 13, the connecting plate 225 fits with the anti-collision groove 131 as well, so that the assembly of the air deflector 1 and the air deflector rotating shaft 22 is more stable.

Further, the thickness of the bent part 221 at the junction between the bent part 221 and the connecting plate 225, is greater than the thickness of the connecting plate 225, moreover, the width of the inserting plate 223 is obviously greater than the thickness of the connecting plate 225, and thus, after the connecting plate 225 is inserted into the anti-collision groove 131, the air deflector 1 is clamped by the bent part 221 and the connecting plate 225 jointly, so as to avoid waggles of the air deflector 1 and significantly reduce noises.

Figure 6:
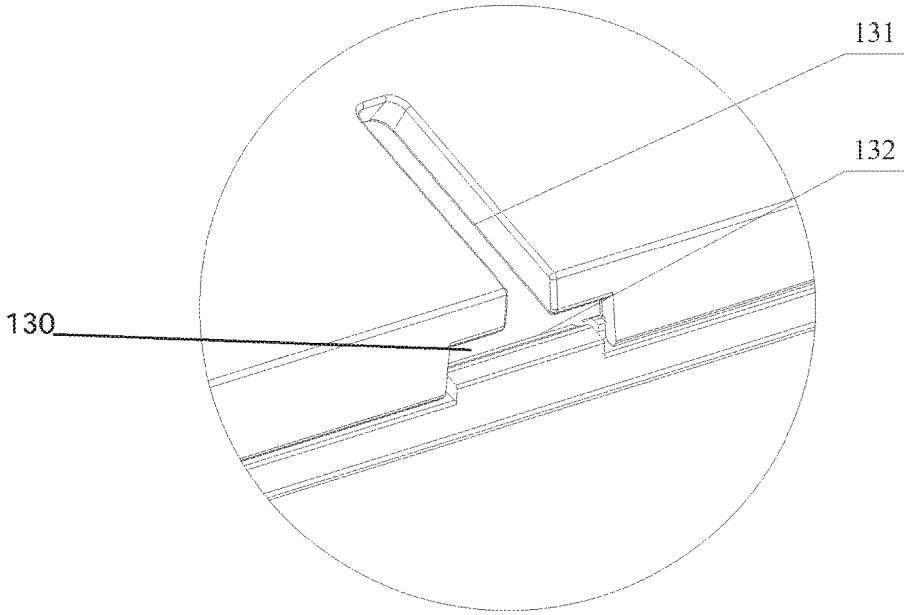
FIG. 6 is an enlarged partial diagram illustrating the part B in FIG. 5.

As shown in FIG. 5 and FIG. 6, in one of the embodiments of the present invention, the air deflector 1 includes an inner part 11 and an outer part 12, which are assembled together. The rotating shaft inserting channel 13 is disposed in the inner part 11 of the air deflector. A stop edge 132 is disposed in the outer part 12 the air deflector for each corresponding rotating shaft inserting channel 13, and extends to the socket 130 of the rotating shaft inserting channel 13.

When the inserting plate 223 is inserted into the rotating shaft inserting channel 13 and goes over the location for the stop edge 132, if no stop edge 132 was provided, the inserting plate 223 would move towards the outer part 12 the air deflector for some distance. Therefore, the stop edge 132 is provided to stop the inserting plate 223, preventing the inserting plate 223 from moving outwards from the rotating shaft inserting channel 13.

Based on the above, when detaching the air deflector 1, a force towards the inner part 11 the air deflector should be exerted on the inserting plate 223, so as to force the inner part 11 the air deflector to deform slightly and keeps the inserting plate 223 away from the stop edge 132; then the air deflector 1 is pulled outwards, and the disassembling of the air deflector 1 and the rotating shaft system 2 is completed.

The present disclosure further discloses an air conditioner, which includes a case, a driving device 3 and an air deflector device. Wherein, the air deflector device is the one as disclosed in the above embodiments. The first connecting part of the rotating shaft system 2 is connected with the driving device 3, and the second connecting part is connected with the case of the air conditioner. As the air deflector device has the technical effects above, the air conditioner having the air deflector device has the same technical effects, which will not be described repeatedly in the present disclosure.

All embodiments in the specification are described one by one progressively, and what described specifically in a subsequent embodiment is only emphasized on the differences from the previous embodiments. The same or the similar technical features of various embodiments can be referenced from each other.

What described above for the embodiments aims at enabling those skilled in the art to realize or utilize the present invention. It is apparent for those skilled in the art that various modifications can be made for these embodiments. The general principles defined in this disclosure can be realized in other embodiments without departing from the spirit or the scope of the present invention. Therefore, the scope of the present invention shall not be limited by the embodiments disclosed herein, but should be interpreted as the widest in accordance with the principles and novel features disclosed in this disclosure.

What is claimed is:

1. An air deflector device, comprising:

an air deflector provided with rotating shaft inserting channels; and a rotating shaft system;

wherein one end of the rotating shaft system is provided with a first connecting part configured to connect with a driving device, and the other end of the rotating shaft system is provided with a second connecting part configured to connect with a case of an air conditioner;

the rotating shaft system comprises at least two air deflector rotating shaft;

every adjacent two rotating shafts are connected through a connecting rod;

each air deflector rotating shaft comprises:

an inserting plate configured to be inserted into and clamped in the corresponding rotating shaft inserting channel in such a manner that the inserting plate is immovable relative to the rotating shaft inserting channel when the air deflector is in operation, and a bent part; and one end of the bent part is provided with a fitting portion matching with the connecting rod, and the other end of the bent part is fixedly connected with the inserting plate.

2. The air deflector device according to claim 1, further comprising a locking post provided in each rotating shaft inserting channel, wherein an end of the inserting plate is provided with a locking groove for clamping the locking post.

3. The air deflector device according to claim 1, wherein the connecting rod and the air deflector rotating shafts are injection molded into an integral piece.

4. The air deflector device according to claim 1, wherein the inserting plate is connected with the bent part through a connecting plate; and each rotating shaft inserting channel includes an anti-collision groove matching with the connecting plate.

5. The air deflector device according to claim 4, wherein a thickness of the bent part at a junction between the bent part and the connecting plate is greater than a thickness of the connecting plate.

6. The air deflector device according to claim 1, wherein the air deflector comprises an inner part and an outer part, which are assembled together;

the rotating shaft inserting channels are disposed in the inner part of the air deflector; and a stop edge is disposed in the outer part of the air deflector for each corresponding rotating shaft inserting channel and extends to a socket of the rotating shaft inserting channel.

7. The air deflector device according to claim 1, wherein the quantity of the air deflector rotating shafts is from 2 to 4.

8. The air deflector device according to claim 2, wherein the quantity of the air deflector rotating shafts is from 2 to 4.

9. The air deflector device according to claim 6, wherein the quantity of the air deflector rotating shafts is from 2 to 4.

10. An air conditioner, comprising a case, a driving device and an air deflector device, the air deflector device comprising:

an air deflector provided with rotating shaft inserting channels; and a rotating shaft system;

wherein one end of the rotating shaft system is provided with a first connecting part configured to connect with the driving device, and the other end of the rotating shaft system is provided with a second connecting part configured to connect with the case of the air conditioner;

the rotating shaft system comprises at least two air deflector rotating shaft;

every adjacent two rotating shafts are connected through a connecting rod;

each air deflector rotating shaft comprises:

an inserting plate configured to be inserted into and clamped in the corresponding rotating shaft inserting channel in such a manner that the inserting plate is immovable relative to the rotating shaft inserting channel when the air deflector is in operation, and a bent part; and one end of the bent part is provided with a fitting portion matching with the connecting rod, and the other end of the bent part is fixedly connected with the inserting plate.

11. The air conditioner according to claim 10, further comprising a locking post provided in each rotating shaft inserting channel, wherein an end of the inserting plate is provided with a locking groove for clamping the locking post.

12. The air conditioner according to claim 10, wherein the connecting rod and the air deflector rotating shafts are injection molded into an integral piece.

13. The air conditioner according to claim 10, wherein the inserting plate is connected with the bent part through a connecting plate; and each rotating shaft inserting channel includes an anti-collision groove matching with the connecting plate.

14. The air conditioner according to claim 13, wherein a thickness of the bent part at a junction between the bent part and the connecting plate is greater than a thickness of the connecting plate.

15. The air conditioner according to claim 10, wherein the air deflector comprises an inner part and an outer part, which are assembled together;

the rotating shaft inserting channels are disposed in the inner part of the air deflector; and a stop edge is disposed in the outer part of the air deflector for each corresponding rotating shaft slot and extends to a socket of the rotating shaft inserting channel.

* * * * *